US008079200B2

(12) United States Patent
Tsutsui et al.

(10) Patent No.: US 8,079,200 B2
(45) Date of Patent: Dec. 20, 2011

(54) BAG TRANSPORT AND TILT-CORRECTION DEVICE

(75) Inventors: Shoji Tsutsui, Iwakuni (JP); Kakue Nakamoto, Iwakuni (JP); Norihiko Yamamoto, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 291 days.

(21) Appl. No.: 12/381,629

(22) Filed: Mar. 13, 2009

(65) Prior Publication Data

US 2009/0233778 A1 Sep. 17, 2009

(30) Foreign Application Priority Data

Mar. 14, 2008 (JP) ..... 2008-066855

(51) Int. Cl.
*B31B 1/90* (2006.01)
*B65B 43/39* (2006.01)

(52) U.S. Cl. ..... 53/133.1; 493/212; 493/923

(58) Field of Classification Search ..... 53/133.1, 53/133.2; 493/212, 923, 929
See application file for complete search history.

(56) References Cited

U.S. PATENT DOCUMENTS

| | | | | |
|---|---|---|---|---|
| 4,712,567 | A * | 12/1987 | Gille et al. | 600/584 |
| 4,768,641 | A * | 9/1988 | Hibi et al. | 198/408 |
| 6,651,407 | B2 * | 11/2003 | Hiramoto et al. | 53/570 |
| 2004/0206056 | A1 | 10/2004 | Hiramoto et al. | |
| 2006/0189466 | A1 | 8/2006 | Tsutsui et al. | |

FOREIGN PATENT DOCUMENTS

| | | |
|---|---|---|
| JP | H7-2235 | 1/1995 |
| JP | 2006-224546 | 8/2006 |
| JP | 2006-240649 | 9/2006 |

* cited by examiner

*Primary Examiner* — Hemant M Desai
(74) *Attorney, Agent, or Firm* — DLA Piper LLP (US)

(57) ABSTRACT

A bag transport and tilt-correction device for a system for, for instance, manufacturing bags with diagonal spouts, the device including openable and closeable gripping members, an air chuck that opens and closes the gripping members, a reciprocal movement mechanism that reciprocates the gripping members between the bag receiving position and the bag hand-over position, and a reciprocal swing mechanisms that swing the gripping members within the vertical plane along the width direction of the gripped bags. The gripping members are moved together with a reciprocal moving body, which is part of the reciprocal movement mechanisms, and attached to the bottom edge of swing levers, which are part of the reciprocal swing mechanism and operated by a cam during the reciprocal movement process, so as to swing together with it. The tilt of the bag is corrected by the swing motion of the gripping members.

3 Claims, 9 Drawing Sheets

BAG TRANSPORT AND TILT-CORRECTION DEVICE

BACKGROUND OF THE INVENTION

1. Field of the Invention

The present invention relates to a bag transport and tilt-correction device that corrects tilt of bags within a bag vertical plane during the process of transporting the bags held in a vertical orientation from a bag receiving position to a bag hand-over position.

2. Description of the Related Art

Japanese Patent Application Laid-Open (Kokai) No. 2006-224546, for instance, discloses a rotary-type bag manufacturing device for manufacturing a bag equipped with a spout. This rotary-type bag manufacturing device includes a plurality of bag-holding units provided on the periphery of an intermittently rotating table and, while the table makes one rotation, receives a supply of bags in each of which the top edge part is opened and the shoulder part is cut diagonally, holds the bag horizontally in the bag-holding units, inserts a spout into the shoulder part of each bag, and adheres the spout to the shoulder part, thus manufacturing a bag equipped with a spout. As shown in FIG. 1 of this Japanese Patent Application Laid-Open (Kokai) No. 2006-224546, the bag equipped with a spout manufactured by this device is conveyed to the outside of the device by a discharge conveyer; and discharged bags with spouts are stacked and, as well known, manually supplied in a vertically stacked state into a bag supply magazine of a bag-supplying device or supplied in a state layered spread out in a cascade like fashion in a conveyer magazine-type bag supply device (in a state layered skewed in the vertical direction so that the top bag comes to the front), and then from there, the bags are supplied to, for example, a rotary-type bag packaging apparatus.

In the case of a bag equipped with a diagonal spout, as seen in typical, common bags, both side edges of such bag are gripped by a gripper in the bag packaging apparatus, the bag mouth is opened, and after the bag is filled with the content, the bag mouth is closed and sealed. However, when this kind of bag with a diagonal spout is supplied to the bag packaging apparatus, if the bag is tilted within the plane, it is gripped and suspended by the gripper in a state tilted within the vertical plane. Tilt within the plane of a bag can also occur for bags not equipped with spouts.

When, as described above, a bag gripped by the gripper is tilted, printing (of, for instance, manufacturing date and expiration date) on that bag performed by the bag packaging apparatus is also tilted, and a bag-mouth seal becomes diagonal with respect to the bag's top edge, deteriorating the visual quality of the bag. Also, when the tilt is great, there is the possibility that other problems would occur in other packaging processes performed by the bag packaging apparatus.

Japanese Patent Application Laid-Open (Kokai) No. 2006-240649 discloses a rotary-type bag packaging apparatus; and in this rotary-type bag packaging apparatus, a tilt detection is performed for a bag gripped by a gripper before opening the bag mouth; and if a tilt is detected, that tilt is corrected during the process of opening the bag mouth. Typically, the tilt correction is performed so that after the bag surface is suction-held by a vacuum-suction disk, the gripper is temporarily opened, the vacuum-suction disk is rotated and the bag is rotated by the amount of the tilt; and after the tilt of the bag is corrected, the gripper is again closed to grip the bag. In this method, since the bag is not tilted after the process of opening the bag mouth, the bag-mouth seal, for instance, will not be diagonal with respect to the bag top edge. However, the printing process is typically performed before the process of opening the bag mouth or before tilt-correction, it is accordingly not possible to prevent inclination in the printing. Also, in the method of Japanese Patent Application Laid-Open (Kokai) No. 2006-240649, it is necessary to temporarily open and close the gripper during the process of opening the bag mouth; as a result, the gripper mechanism is complex, extra time is required for opening and closing of the gripper, and thus it has a problem that the productivity of the bag packaging apparatus is low.

BRIEF SUMMARY OF THE INVENTION

Accordingly, the main object of the present invention is to correct tilt of a bag without causing a bag packaging apparatus to become complex and without causing a decrease in productivity.

In addition, though the current rotary-type bag manufacturing device for manufacturing a bag equipped with a spout and the current rotary-type bag packaging apparatus are conventionally not linked together as described above, if such a device and an apparatus are linked so that bags with spouts manufactured by the rotary-type bag manufacturing device are continuously supplied without being stacked to the rotary-type bag packaging apparatus, then the bag manufacturing process and the bag packaging process are performed smoothly and continuously, and it becomes possible to perform bag manufacturing and bag packaging more efficiently. Accordingly, it is another object of the present invention to provide a means for correcting tilt of bags that is applicable to this kind of system as well.

The above object are accomplished by a unique structure of the present invention for a bag transport and tilt-correction device for correcting the tilt of a bag supplied to a rotary-type bag packaging apparatus before it is supplied thereto; and in the present invention, the bag transport and tilt-correction device comprises:

- a gripping member which is openable and closable and, when closed, grips the top edge part of a bag supplied in a substantially vertical orientation and suspends the bag,
- an opening and closing mechanism for opening and closing the gripping member,
- a reciprocal movement mechanism for reciprocating the gripping member between a bag receiving position and a bag hand-over position, and
- a reciprocal swing mechanism for swinging the gripping member within a vertical plane along a width direction of the gripped bag during the reciprocating motion of the gripping member; and in this structure, the gripping member is:

- closed at the bag receiving position to grip the top edge part of a bag,
- swung within the vertical plane during the process of being moved to the bag hand-over position to correct tilt of the bag, and
- opened at the bag hand-over position to release the bag.

In this bag transport and tilt-correction device,

- the reciprocal movement mechanism is provided with a reciprocal moving body that reciprocates in a horizontal direction, and the gripping member is supported on the reciprocal moving body so as to swing within the vertical plane,
- the reciprocal swing mechanism is comprised of
  - a swing lever connected to a swing shaft of the gripping member,
  - a cam rail installed along a direction of the movement of the reciprocal moving body on a fixed frame, the height of the cam rail being adjustable along the length direction of the cam rail, a driven body which is moved on the cam rail by the reciprocating motion of the reciprocal moving body, and a linking mechanism that links the swing lever and the driven body; and in this structure, during the reciprocating motion of the reciprocal moving body, the swing lever swings within the vertical plane via the driven body and the linking mechanism, and the gripping member swings within the vertical plane.

In the present invention, it is also possible that the cam rail is designed so as to be adjustable in its height by a servo motor, and a detection means for detecting the tilt of a supplied bag is provided, so that the servo motor is controlled by detection signals of the detection means.

According to the bag transport and tilt-correction device of the present invention, it is possible to correct the tilt of the bags supplied to the bag packaging device before they are supplied thereto. Thus, the occurrence of tilt in the printing and bag-mouth sealing process for the product bags (bags with the content inside) is prevented without causing the bag packaging device to be complicated in structure and/or causing the productivity to decrease. It is also possible to prevent occurrence of problems caused by bags, which are tilted, in any of the packaging processes performed by the bag packaging device.

In addition, the bag transport and tilt-correction device according to the present invention is easily applicable to a packaging system that is for manufacturing bags equipped with spouts and packaging thereof and comprises a conventional rotary-type bag packaging apparatus and a conventional rotary-type bag packaging apparatus that are linked together.

DETAILED DESCRIPTION OF THE INVENTION

The present invention will be described below in detail with reference to the accompanying drawings of FIG. 1 through FIG. 8.

Figure 1:
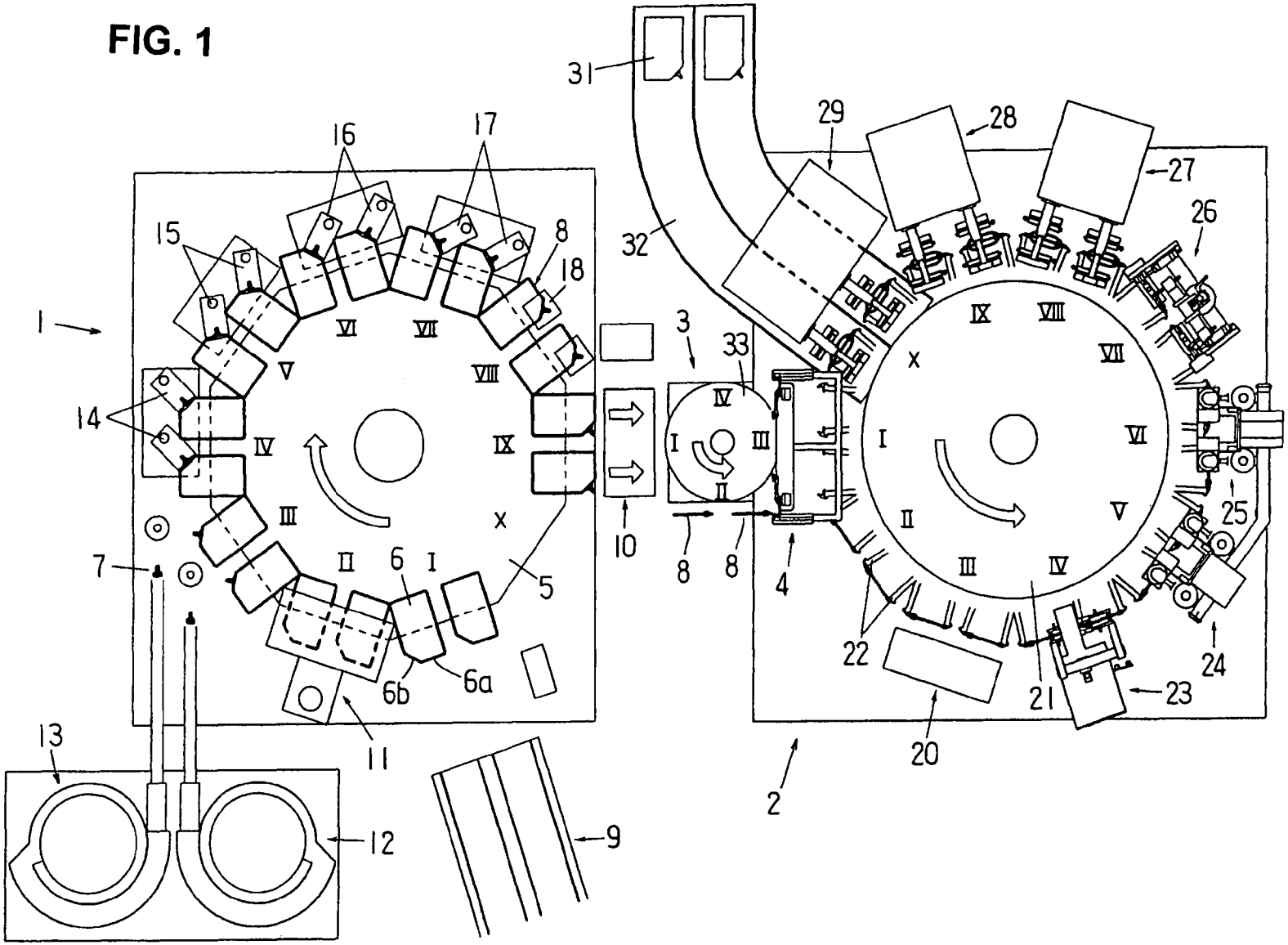
FIG. 1 is a top view of the system for manufacturing bags equipped with spouts and for packaging the bags according to the present invention.

First, FIG. 1 is a top view of a system for manufacturing bags equipped with spouts and for packaging the bags that uses the bag transport and tilt-correction device of the present invention. This system includes a rotary-type bag manufacturing device 1 for manufacturing bags equipped with diagonal spouts, a rotary-type bag packaging device 2, a rotary-type bag transport device 3 provided between the rotary-type bag manufacturing device 1 and the rotary-type bag packaging device 2, a bag receiving and transfer device 10 provided between the rotary-type bag manufacturing device 1 and the rotary-type bag transport device 3, and a bag transport and tilt-correction device 4 provided between the rotary-type bag transport device 3 and the rotary-type bag packaging device 2.

The rotary-type bag manufacturing device 1 for manufacturing bags equipped with spouts includes a plurality of bag-holding units (not illustrated) set on the periphery of an intermittently rotating table 5; and while the table 5 makes one rotation, the rotary-type bag manufacturing device 1 receives a supply of bags 6 in each of which the top edge part **6*a* is opened and the shoulder part 6*b* is cut diagonally (see FIG. 1), and it holds these bags horizontally in the bag-holding units, inserts a spout 7 into the shoulder part 6*b* of each bag, and adheres the spout 7 to the shoulder part 6*b*, thus manufacturing bags 8** equipped with diagonal spouts (see Japanese Patent Application Laid-Open (Kokai) No. 2006-224546).

This rotary-type bag manufacturing device 1 for manufacturing bags equipped with spouts is a W-type device, and it performs the manufacturing operation on two bags simultaneously, and thus the bag-holding units are provided at equal angle intervals of ten (10) sets each comprising two bag-holding units. On each bag-holding unit, a bag holding member and a spout-holding member (neither of these illustrated) are provided.

More specifically, in the rotary-type bag manufacturing device 1, the table 5 stops ten times while it makes one rotation; and at each stop position, each process for manufacturing the bags 8 equipped with diagonal spouts (also called "diagonal spout-equipped bag(s)") is performed in sequence. In other words, at the stop position I, a conveyor magazine-type bag supply device 9 is provided, and two bags 6 are supplied simultaneously to the bag-holding units. A bag-positioning device 11 is provided at the stop position II, wherein positioning of the bags 6 to the bag-holding units is performed, and subsequently, the bags 6 are held in the bag-holding units by the bag holding member. Spout supply devices 12 and 13 and a device for opening the bag mouth (not illustrated) are provided at the stop position III, wherein opening of the bag mouth including the shoulder part **6*b* and supplying of the spout 7 (insertion into the bag mouth) are performed. The spout 7 inserted into the bag mouth is held by the spout-holding member. Sealing devices (only the heat plates 14, 15, and 16 are shown) are provided at the stop positions IV to VI, and a cooling device (only the cooling plates 17 are shown) is provided at the stop position VII, so that adhesion sealing and cooling of the shoulder part 6*b* and spout 7 are performed. A testing device 18 for testing the attachment positions of the spouts 7 is provided at the stop position VIII, and bags 8 equipped with diagonal spouts are taken out by the bag receiving and transfer device 10** at the stop position IX.

On the other hand, the rotary-type bag packaging device 2 includes a plurality of pairs of grippers 22 provided on the periphery of an intermittently rotating table 21; and while the table 21 makes one rotation, the rotary-type bag packaging device 2 receives a supply of the bags 8 equipped with diagonal spouts and grips both edges of each one of the bags 8 using the grippers 22, and further it opens the bag mouth of the diagonal spout-equipped bag 8, fills the inside of the bag 8 with the item to be filled (content), and then seals the bag mouth (or the upper edge part 6*a*).

This rotary-type bag packaging device 2 is also a W-type device so that it performs the packaging operation of two bags simultaneously, and two pairs of grippers are installed at equal angle intervals (see Japanese Patent Application Laid-Open (Kokai) 2004-244085).

Figure 9:
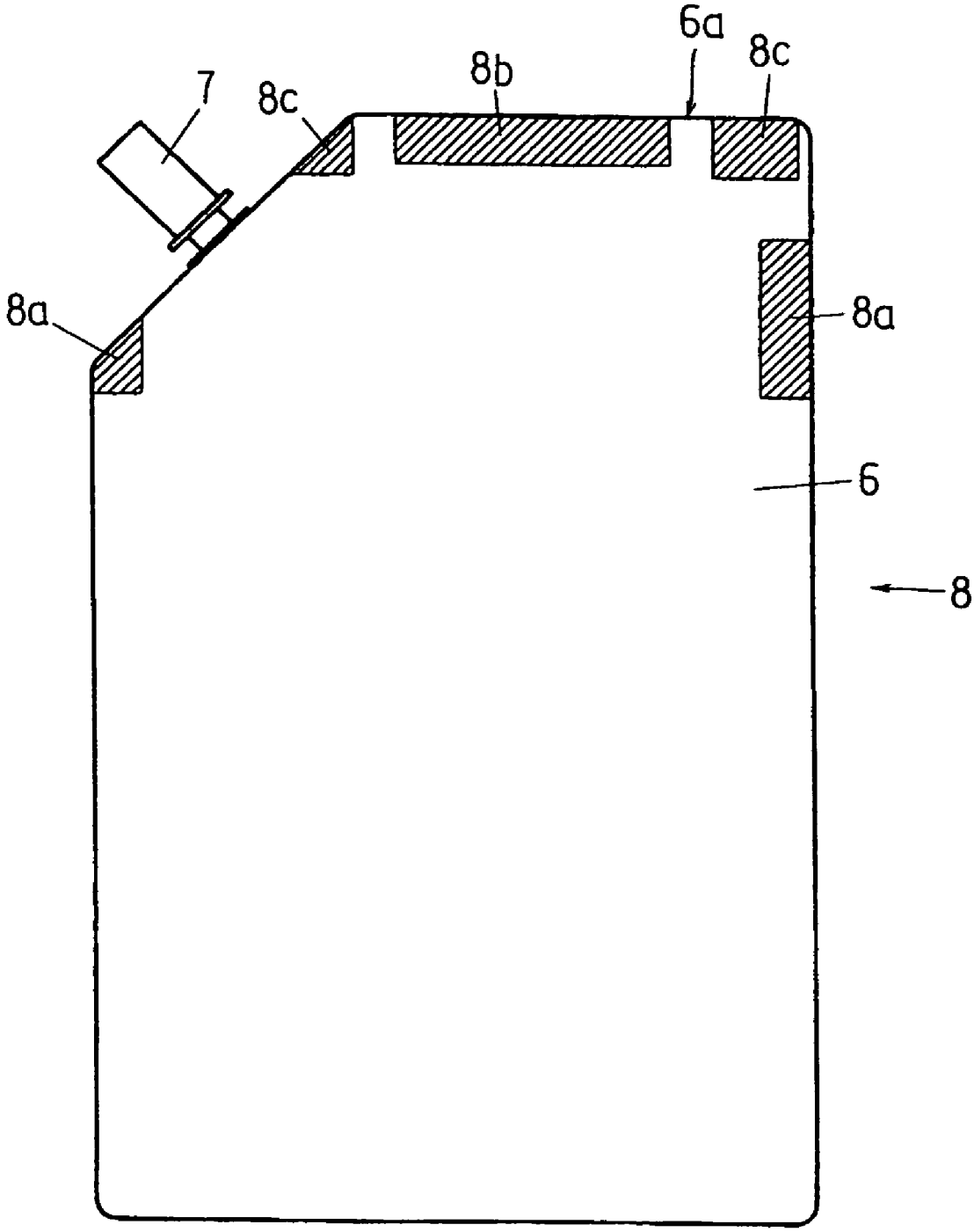
FIG. 9 shows a bag equipped with a diagonal spout, indicating part to be gripped by the grippers and part to be gripped by the gripping members.

More specifically, in this rotary-type bag packaging device 2, the table 21 stops ten times while it makes one rotation, and the packaging process including, among others, filling the content in the bag 8 equipped with a diagonal spout and sealing the bag 8 are performed in sequence at each stop position. In other words, at the stop position I, a supply of diagonal spout-equipped bags 8 is received two bags at a time from the bag transport and tilt-correction device 4, and both edges of each bag (or parts to be gripped 8*a*) are gripped by the gripper 22 so that the bags are suspended vertically. FIG. 9 shows parts 8*a* to be gripped in the bag 8 which is equipped with a diagonal spout. The stop position II is for the idle process; and at the stop position III, a printing device 20 is installed so that printing on the bag surface of the bag 8 equipped with a diagonal spout is performed here. At the stop position IV, an opening device 23 that opens the diagonal spout-equipped bags 8 is installed. Liquid filling devices 24 and 25 are, in the shown structure, respectively installed at the stop positions V and VI, and liquid (content) filling is performed for the diagonal spout-equipped bags 8. A gas-flushing device 26 is installed at the stop position VII, and the air in the bags is replaced by inert gas sprayed from the nozzle of the gas-flushing device 26. A press degassing device (not illustrated) and a first sealing device 27 are installed at the stop position VIII, and a first sealing of the bag mouth is performed by press-degassing and a heat plate; and a second sealing device 28 is installed at the stop position IX so that a second sealing is performed to the bag 8 by the heat plates. A cooling device 29 is installed at the stop position X, and cooling for the sealed part of each bag is performed by the cooling plates, and further, the grippers 22 are opened at this stop position X, and product bags 31 (on which all the packaging steps have been completed) are dropped, so that the product bags 31 are conveyed to the outside of the rotary-type bag packaging device 2 via a chute 32.

The rotary-type bag transport device 3 includes a plurality of pairs of gripping members (not illustrated) installed on the periphery of an intermittently rotating table 33, and the part to be gripped 8*b* set on the center portion of the upper edge part 6*a* of each one of the diagonal spout-equipped bags 8 supplied in a vertical orientation is gripped by the gripping member and rotated and then transported. This rotary-type bag transport device 3 is also a W-type device so that it (the gripping members) grips, rotates and transports two bags simultaneously; and corresponding to each one of the stop positions, one set of two gripping members is installed at equal angle intervals. The table 33 stops four times while it makes one rotation; and the rotary-type bag transport device 3 receives a supply of two diagonal spout-equipped bags 8 from the bag receiving and transfer device 10 at the stop position I, the gripping members grip the upper edge parts 6*a* of the bags, and the gripping members are next opened at the stop position III to transfer the bags to the bag transport and tilt-correction device 4.

As described above, the rotary-type bag transport device 3 is provided with the gripping members that grip the bag upper edge part 6*a* of each one of the bags 8; however, instead of the gripping members, a plurality of pairs of grippers that (is an equivalent to the gripper 22 of the rotary-type bag packaging device 2 and) grip both edges of the bag can be employed. In this case, instead of the part to be gripped 8*b*, each bag 8 is gripped at the parts to be gripped 8*a* or nearby. In addition, if the gripping members or grippers of the rotary-type bag transport device 3 can make transfer of the bags with the gripping members 34 and 35 of the bag transport and tilt-correction device 4 that will be described below, then the construction of the gripping members or grippers and the gripping part positions can be changed to other structures and positions.

Between the rotary-type bag manufacturing device 1 for manufacturing bags equipped with spouts and the rotary-type bag transport device 3 is provided the bag receiving and transfer device 10. The bag receiving and transfer device 10 receives the diagonal spout-equipped bags 8 in a horizontal orientation from the bag-holding units of the rotary-type bag manufacturing device 1, converts the bags into to a vertical orientation, and then transfers the bags to the gripping members that are stopped at the stop position I of the rotary-type bag transport device 3. This bag receiving and transfer device 10 also is a W-type device, and it is possible to receive and transfer two bags simultaneously. For the bag receiving and transfer device 10, a device that uses a suction disk mechanism can be used. When such a device with suction disk mechanism, the bag surface of each one of the diagonal spout-equipped bags 8 in the bag-holding units is suctioned and raised, and then the bags are subsequently converted into a vertical orientation while being rotationally transported upward in a circular shape (see U.S. Pat. No. 3,084,539 and Japanese Patent Application Laid-Open (Kokai) No. 2006-36325, for example).

In this bag receiving and transfer device 10, if a diagonal spout-equipped bag is determined to be defective by the testing device 18, such a bag is dropped, for instance, below without being transferred to the rotary-type bag transport device 3.

The bag transport and tilt-correction device 4 receives the diagonal spout-equipped bags 8 from the gripping members of the rotary-type bag transport device 3, horizontally transports these bags which are in the vertical orientation; and during this transporting process, the bag transport and tilt-correction device 4 corrects the tilt of the bags 8 within the vertical plane thereof, and then transfers the bags to the grippers 22 of the rotary-type bag packaging device 2. The bag transport and tilt-correction device is also a W-type device so that it receives and transfers two bags at the same time.

The bag transport and tilt-correction device 4 will be described in detail below with reference to FIG. 2 through 6.

Figure 2:
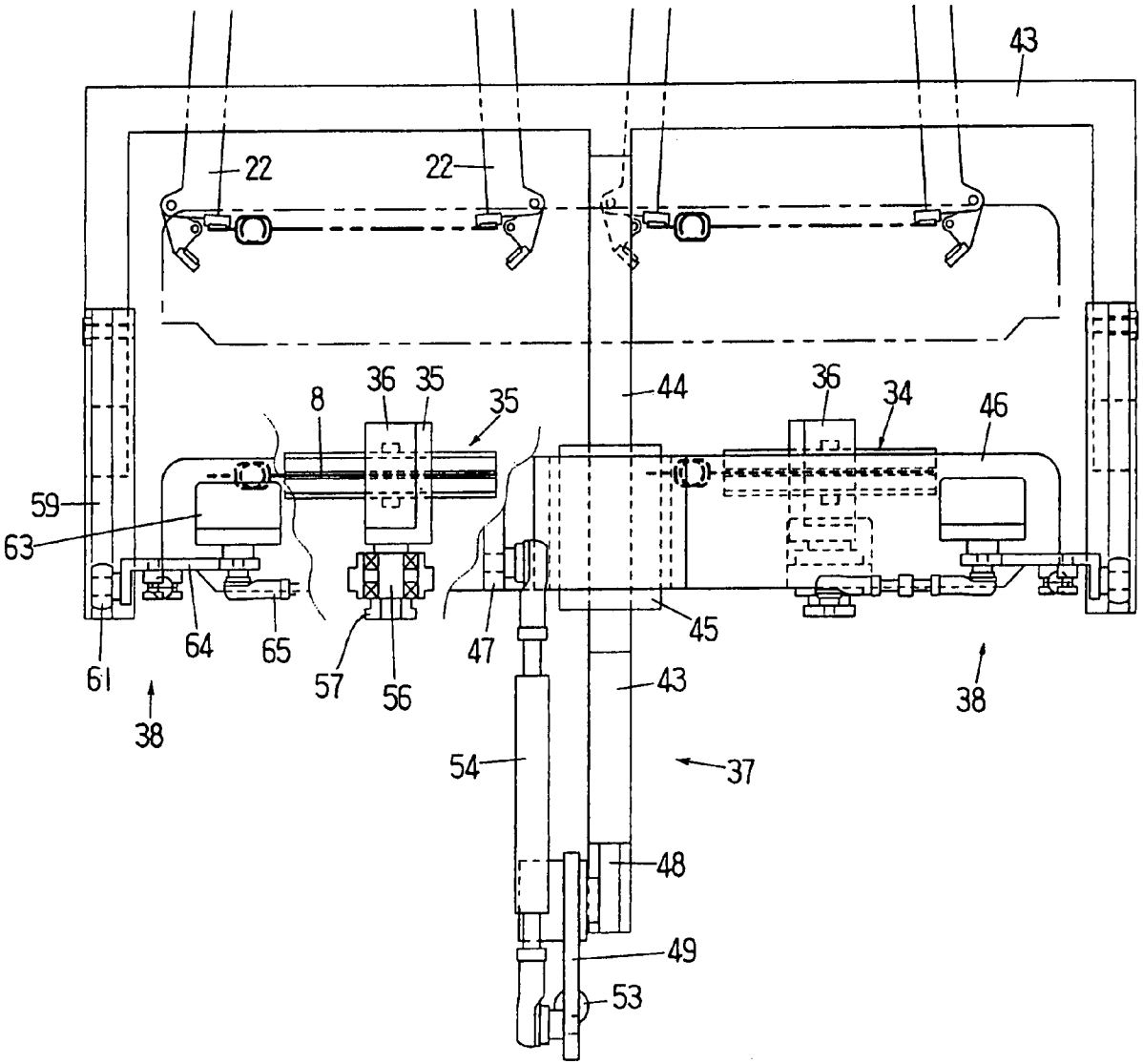
FIG. 2 is a partial cross-sectional top view of the bag transport and tilt-correction device according to the present invention.
Figure 3:
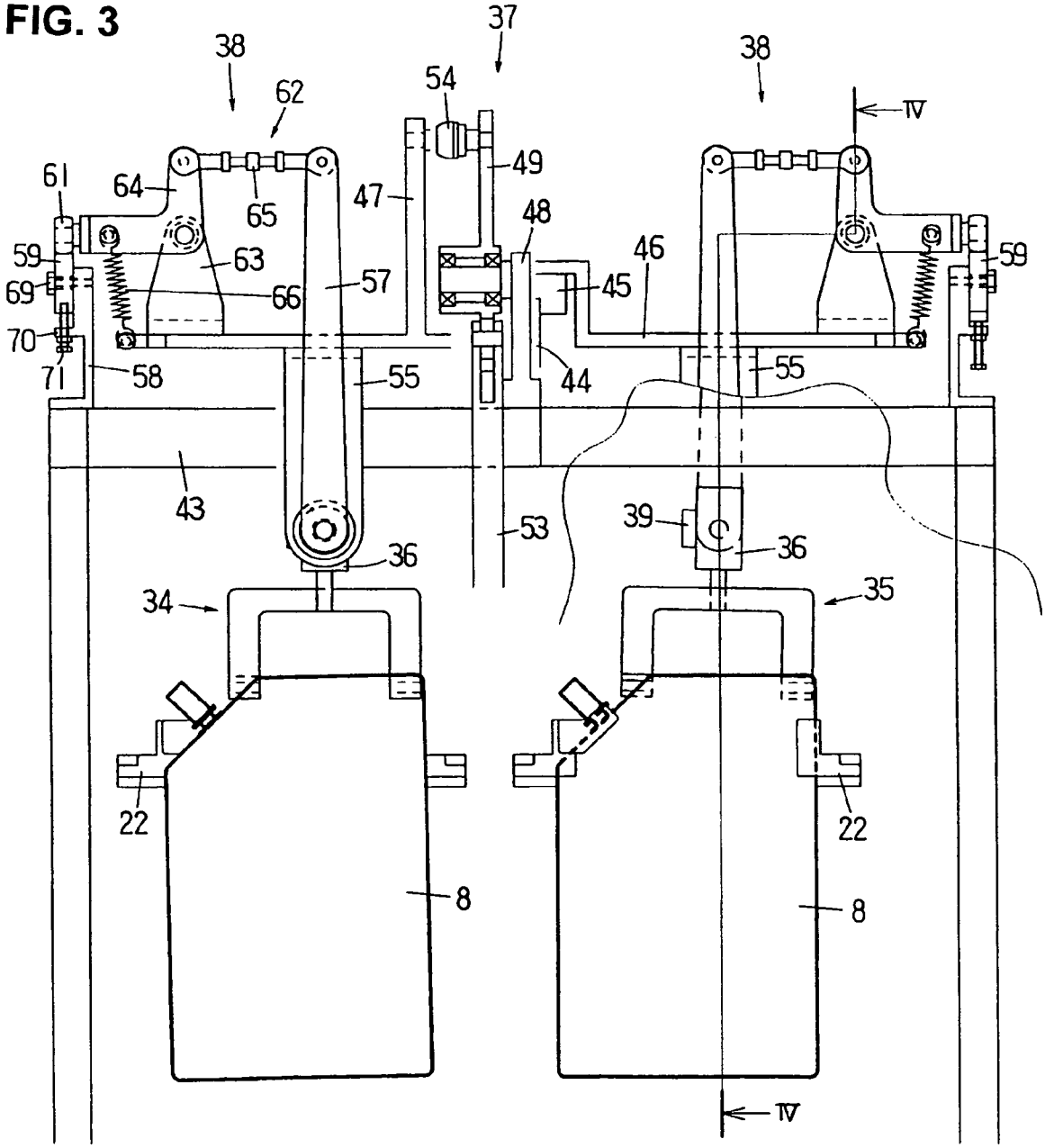
FIG. 3 is a front view (partially in cross section indicated by waved line) of FIG. 2.
Figure 4:
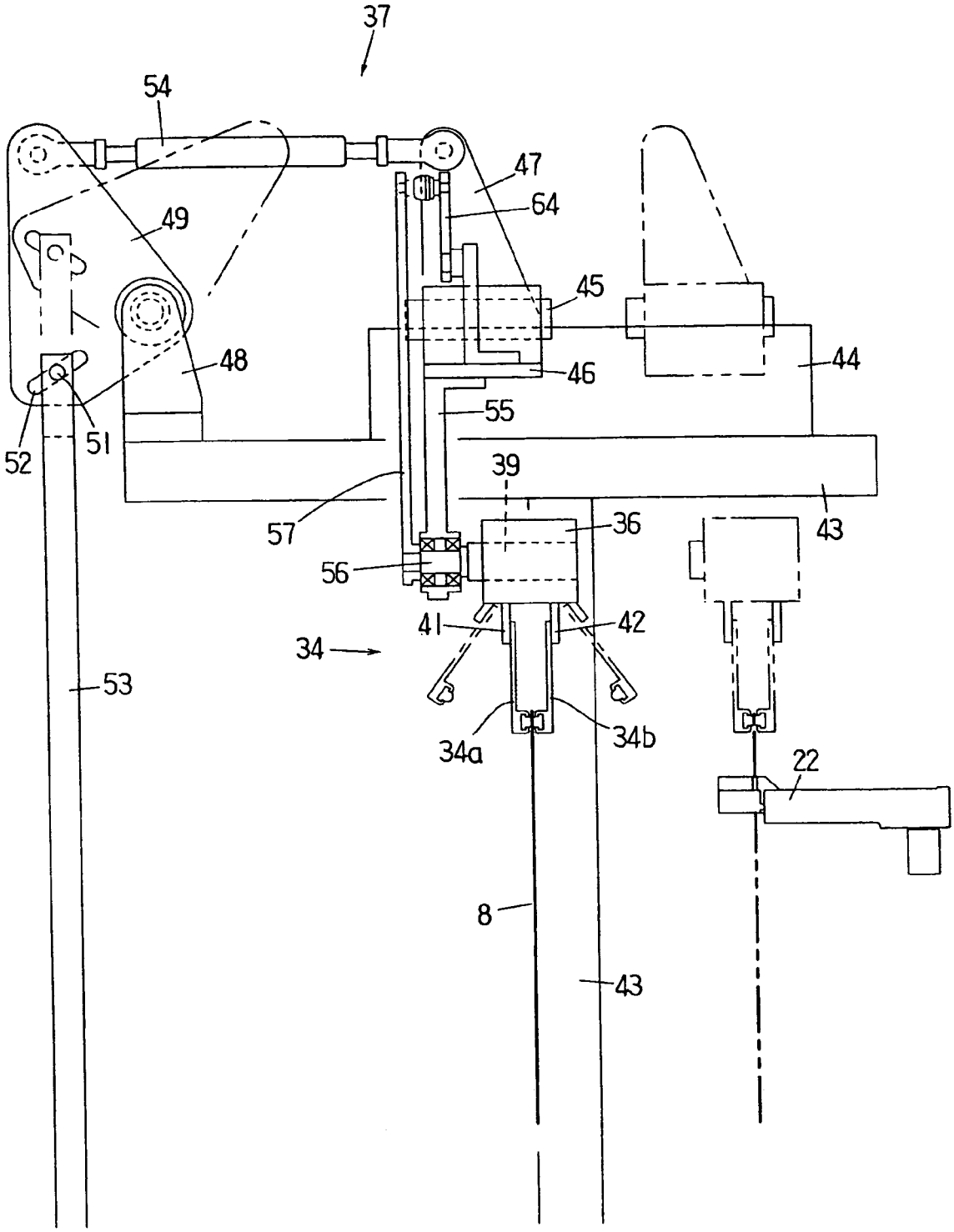
FIG. 4 is a cross-sectional view taken along the lines IV-IV in FIG. 3.
Figure 5:
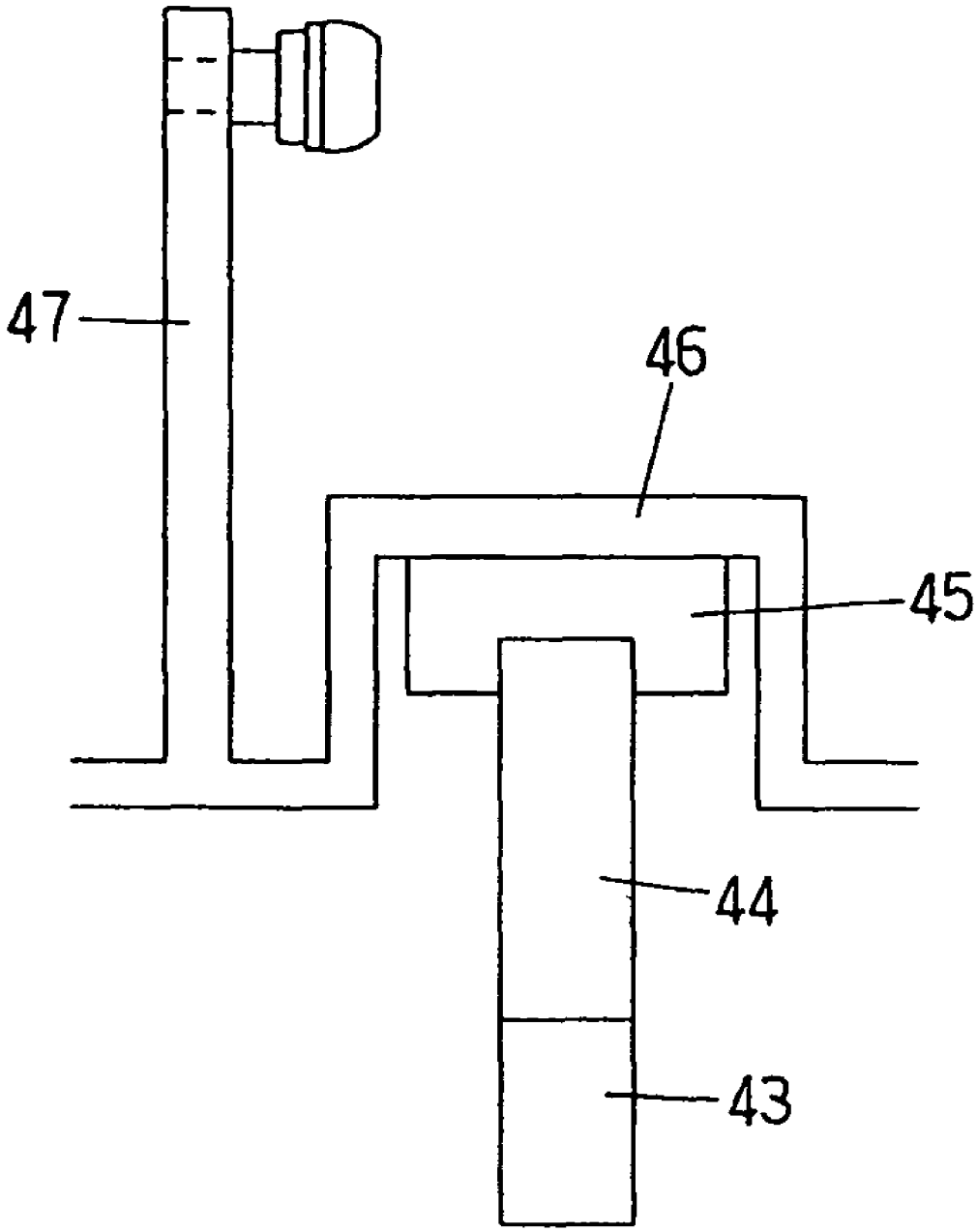
FIG. 5 is a front view of near the slide rail of the bag transport and tilt-correction device shown in FIG. 2.

As seen from FIG. 2 through FIG. 4, the bag transport and tilt-correction device 4 is comprised of gripping members 34 and 35, an opening and closing mechanism 36 that opens and closes the gripping members 34 and 35, and a reciprocal movement mechanism 37 that reciprocates the gripping members 34 and 35 back and forth between a specified bag receiving position and a specified bag hand-over position. The bag transport and tilt-correction device 4 is further comprised of reciprocal swing mechanisms 38 that respectively swing the gripping members 34 and 35 in a vertical plane along the width direction of each one of the diagonal spout-equipped bags 8 (lateral (left and right) direction in FIG. 2 and FIG. 3) that are gripped by the gripping members 34 and 35.

More specifically, each one of the gripping members 34 and 35 is comprised of a pair of gripping pieces that respectively are of a gate shape (or a reversed angled U shape) and open and close (in FIG. 4, the gripping pieces of the gripping member 34 are shown by the reference numerals 34*a* and 34*b*); and as shown in FIG. 3, each one of the gripping members 34 and 35 takes a gate shape (or a reversed angled U shape) when viewed from the front, and they respectively grip, with their bottom edge gripping parts, the parts to be gripped 8*c* which are at both sides of the upper edge part 6*a* of the diagonal spout-equipped bag 8, so that the bag 8 is suspended in a vertical orientation. These gripping members 34 and 35 respectively have a gate-shaped space, and their gripping position differs from those of the gripping members of the rotary-type transport device 3. Accordingly, though they all grip the upper edge part 6*a* of a bag in a similar fashion, there is no mutual interference between the gripping members 34 and 35 of the bag transport and tilt-correction device 4 and the gripping members of the rotary-type transport device 3 (the tip of the gripping members of the rotary-type transport device 3 can advance and recede (or pass through) without interfering with the gate-shaped spaces of the gripping members 34 and 35).

The opening and closing mechanism 36 for each one of the gripping members 34 and 35 consists of an air chuck fixed to an L-shaped piece 39 (hereafter called air chuck 36). The gripping pieces 34*a* and 34*b* of the gripping member 34 (the gripping pieces for the gripping member 35 are the same as the gripping pieces 34*a* and 34*b* of the gripping member 34) are fixed to a pair of opening and closing rods 41 and 42 that protrude downward from the main body of the air chuck 36; and as the opening and closing rods 41 and 42 open and close, the gripping pieces of the gripping members 34 and 35 are opened and closed in parallel to the length direction of a slide rail 44 that will be described below, and the diagonal spout-equipped bags 8 gripped by the gripping members 34 and 35 are suspended within the plane perpendicular to the length direction of the slide rail 44.

The reciprocal movement mechanism 37 of the bag transport and tilt-correction device 4, as best seen from FIG. 4 (and FIG. 5), is comprised of the slide rail 44 provided horizontally on the top surface of a frame 43, a slide member 45 that slides on the slide rail 44 in the length direction, a plate-shaped reciprocal moving body 46 provided on the slide member 45, a linking member 47 erected on the top surface of the reciprocal moving body 46, a support member 48 fixed to the frame 43, and a triangular lever 49 supported to swing on the support member 48 within a vertical plane parallel to the length direction of the slide rail 44. The reciprocal movement mechanism 37 further includes an ascending/descending shaft 53 connected to a drive source (not illustrated) and moved up and down vertically, an engagement pin 51 fixed to the tip end of the ascending/descending shaft 53 and slidably engaged with a slot 52 formed in the bottom edge corner of the triangular lever 49, and a linking shaft 54 of which both ends are respectively connected so as to be able to turn to the top edge corner of the triangular lever 49 and the linking member 47. The reciprocal movement mechanism 37 still further includes support members 55 fixed to the bottom surface of the reciprocal moving body 46, swing shafts 56 having axes parallel to the length direction of the slide rail 44 and supported rotatably at the bottom ends of the support members 55, and the L-shaped piece 39 fixed to one end of each of the swing shafts 56.

When the ascending/descending shaft 53 is moved up and down, the reciprocal moving body 46 is moved horizontally back and forth (reciprocates) a specified distance within the horizontal plane; and during this reciprocating movement, the gripping members 34 and 35 are horizontally moved back and forth (reciprocate) in a horizontal plane between the bag receiving position and the bag hand-over position described below.

Each of the reciprocal swing mechanisms 38 of the bag transport and tilt-correction device 4 is comprised of a swing lever 57 of which bottom end is fixed to the other end of the swing shaft 56 ("the other end" being the opposite side from the side to which the L-shaped piece 39 is attached), a cam rail 59 provided in parallel to the length direction of the slide rail 44 via an attachment member 58 on the frame 43, a driven body (driven roller) 61 that rolls on the cam rail 59, and a linking mechanism 62 that links the swing lever 57 and the driven roller 61. The linking mechanism 62 consists of a support member 63 fixed to the reciprocal moving body 46, an L-shaped lever 64 supported at its corner portion by the support member 63 so as to swing within the plane perpendicular to the length direction of the slide rail 44, a linking shaft 65 rotatably linked to the top end of the L-shaped lever 64 and to the top end of the swing lever 57, and a spring 66 provided between the L-shaped lever 64 and the reciprocal moving body 46 so as to constantly urge the drive roller 61 toward the cam rail 59. The driven roller 61 is provided at one end of the L-shaped lever 64.

Figure 6:
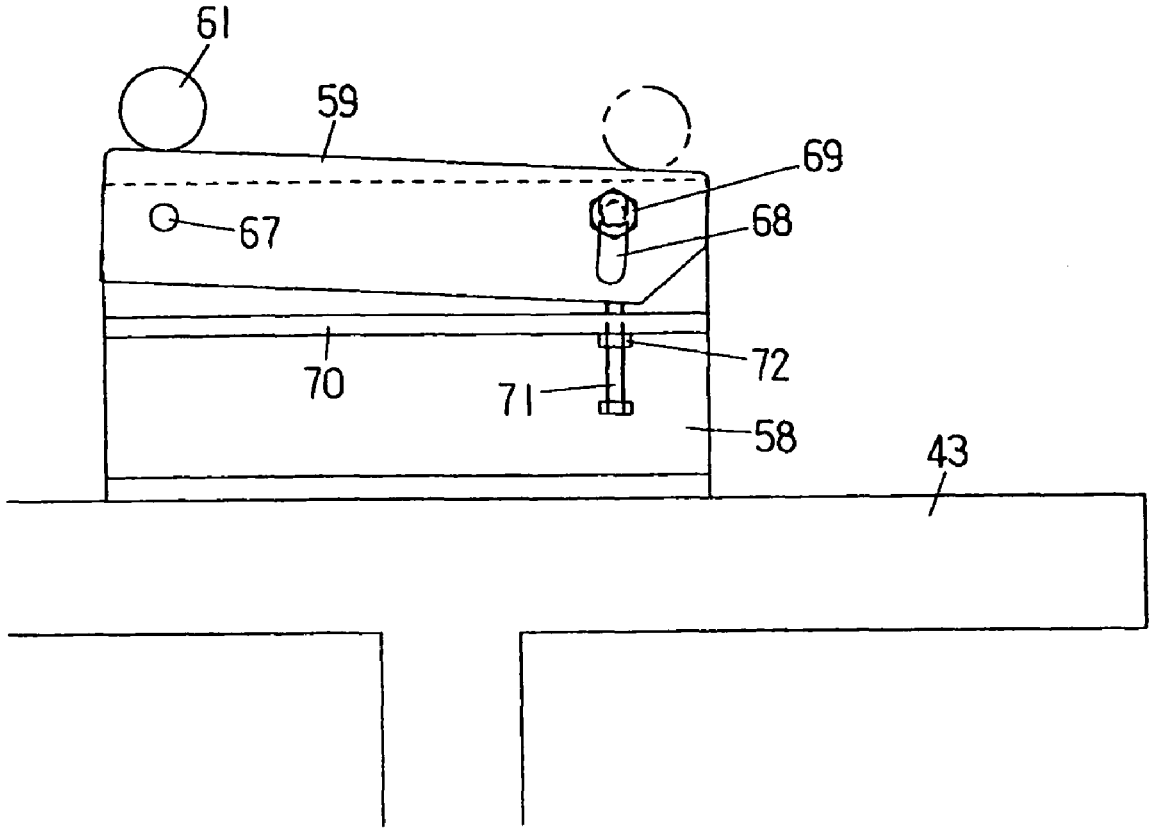
FIG. 6 is a right side view near the cam rail (for the gripping member) of the bag transport and tilt-correction device shown in FIG. 2.

As shown in FIGS. 3 and 6, each of the cam rails 59 is at its one end supported rotatably by the attachment member 58 using a support pin 67 and is at near its another end formed with a slot 68 which is in an arc shape, and it is fixed to the attachment member 58 by a lock bolt 69. In addition, the tip end of the adjustment bolt 71 that is screwed to the rib 70 of the attachment member 58 abuts the bottom end of the cam rail 59 and is tightened by a lock nut 72. The cam rail 59 is adjustable in its height in the direction thereof (inclined with respect to the horizontal plane) by the lock bolt 69 and adjustment bolt 71. The cam rail 59 shown in FIG. 6 corresponds to the gripping member 35, and the top surface of the cam rail 59 (the cam surface) becomes lower (it is inclined downward as it faces forward) the further forward it goes (the closer it gets to the bag hand-over position). The height (incline) along the length direction of the left side cam rail 59 and of the right side cam rail 59 is reversed, and the top surface of the cam rail 59 that corresponds to the gripping member 34 becomes higher the further forward it goes (inclined upward as it faces forward).

When the reciprocal moving body 46 is moved back and forth (reciprocates), the driven rollers 61 accordingly roll on the cam rails 59; and when the top surfaces of the cam rails 59 (cam surfaces) are inclined, the L-shaped levers 64 swing; and as a result, the swing levers 57 swing, the swing shaft 56 turns, and via the L-shaped pieces 39 and the air chucks 36, the gripping members 34 and 35 swing (incline) within the vertical plane (within the vertical plane perpendicular to the length direction of the slide rail 44) along the width direction of the diagonal spout-equipped bags 8 that are gripped by the gripping members 34 and 35.

Next, the operation of the bag transport and tilt-correction device 4 will be described below.

As shown by the solid lines in FIG. 2 and FIG. 4, when the ascending/descending shaft 53 is at the descended position, the reciprocal moving body 46 is at the most-retreated position, and the gripping members 34 and 35 are at the bag receiving position. The bag receiving position is the position where the gripping members 34 and 35 receive the bags 8 equipped with diagonal spouts from the grippers of the rotary-type bag transport device 3 (this is the bag hand-over position for the rotary-type bag transport device 3); and when the diagonal spout-equipped bags 8, in which the bag upper edge part 6*a* (part to be gripped 8*b*) is gripped by the gripping member of the rotary-type bag transport device 3, are stopped at this bag receiving position, the gripping members 34 and 35 that have been in an open state (shown by the imaginary (two-dotted) lines) are closed and grip the upper edge parts 6*a* (part to be gripped 8*c*) of the bags 8 equipped with diagonal spouts, and subsequently, the gripping members of the rotary-type bag transport device 3 are opened to release the diagonal spout-equipped bags 8.

Next, the ascending/descending shaft 53 is moved upward; and when the reciprocal moving body 46, as a result, advances and comes to the most-advanced position as shown by the imaginary (two-dotted) lines in FIG. 4, the gripping members 34 and 35 come to the bag hand-over position and stop. The bag hand-over position is the position at which the bags 8 equipped with diagonal spouts are transferred to the grippers 22 of the rotary-type bag packaging device 2 from the gripping member 34 and 35 (this is the bag receiving position for the rotary-type bag packaging device 2); and when the gripping members 34 and 35 are stopped at this bag hand-over position, the grippers 22 that have been in an open state are closed and grip both side edges of the bags 8 equipped with diagonal spouts, and subsequently the gripping members 34 and 35 are opened and release the diagonal spout-equipped bags 8.

As shown in FIG. 3, each gripper 22 grips both side edge parts of the bag 8 equipped with a diagonal spout and also grips the spout 7 so as to lightly hold it. This is to prevent the spout 7 from swaying while undergoing each packaging operation and becoming a hindrance to the packaging operation.

While the reciprocal moving body 46 advances and the gripping members 34 and 35 are moved from the bag receiving position to the bag hand-over position, the gripping members 34 and 35 as described previously swing (incline) within the vertical plane along the width direction of the gripped bag 8 that is equipped with a diagonal spout (within the vertical plane perpendicular to the length direction of the slide rail 44), and thus the tilt of the bag 8 equipped with a diagonal spout is corrected. FIG. 3 shows the gripping member 34 gripping the bag 8 equipped with a diagonal spout at the bag receiving position, and it also shows the gripping member 35 in a state subsequently moved to the bag hand-over position, and the gripping member 35 swung and tilts slightly to the left in FIG. 3 (the right side shoulder of the gripping member 35 is thus slightly lower than the left side shoulder), and the tilt of the diagonal spout-equipped bag 8 is corrected.

When the reciprocal moving body 46 retreats and the gripping members 34 and 35 are moved from the bag hand-over position to the bag receiving position, the gripping members 34 and 35 obviously swing in the reverse direction.

In the above action of the gripping members 34 and 35, the diagonal spout-equipped bags 8 manufactured by the rotary-type bag manufacturing device 1 for manufacturing bags equipped with spouts are transported via the bag receiving and transfer device 10 and the rotary-type bag transport device 3, and if the bags are not tilted when they are gripped by the gripping members 34 and 35, then it is not necessary to perform the above-described tilt-correction by the bag transport and tilt-correction device 4. However, in the case of bags, particularly in the case of a bag 8 equipped with a diagonal spout which is laterally asymmetrical, when the spout 7 is adhesion-sealed to the shoulder part 6*b* of the bag 6, the bag can be easily skewed to one side to tilt in the bag-holding unit, and this tilt is not eliminated until the bag is gripped by the gripping members 34 and 35 of the bag transport and tilt-correction device 4 via the bag receiving and transfer device 10 and the rotary-type bag transport device 3 (if the initial setting is done accurately, the bag would not tilt in the bag receiving and transfer device 10 and the rotary-type bag transport device 3).

In the rotary-type bag manufacturing device 1 for manufacturing bags equipped with spouts, by way of changing the position settings of the conveyor magazine-type bag supply device 9, the sealing device, the cooling device and the like, it is not impossible to prevent tilt of the bag (make position settings for these devices with the bag position skew incorporated in advance). However, the level of tilt differs depending upon the manufacturing conditions (bag size, type, sealing conditions and the like), and performing the above-described position setting each time the manufacturing conditions change would be a difficult task and is not realistic. Accordingly, it is reasonable to admit that the rotary-type bag manufacturing device 1 for manufacturing bags equipped with spouts would manufacture tilted bags with diagonal spouts and therefore cause the bag transport and tilt-correction device 4 correct such tilt of the diagonal spout-equipped bags.

The tilt of each one of the diagonal spout-equipped bags 8 that are manufactured by the rotary-type bag manufacturing device 1 and gripped by the gripping members 34 and 35 is kept almost consistent during the manufacturing, if the manufacturing conditions (bag size, type, sealing conditions and the like) are the same; accordingly, it is only sufficient to set the height (incline) along the length direction of the cam rail 59 in advance to a value for which the tilt can be corrected (preferably eliminated). If the manufacturing conditions change, then the height (incline) along the length direction of the cam rail 59 is changed to a setting according to the manufacturing conditions. The settings can be changed by loosening the lock bolt 69, the adjustment bolt 71 and the lock nut 72, turning the cam rail 59 around the support pin 67 to set it to a specified incline, and then again tightening back the lock bolt 69, the adjustment bolt 71 and the lock nut 72.

The above-described bag transport and tilt-correction device 4 is a W-type device, and a pair of the reciprocal swing mechanisms 38 are installed symmetrically as shown in FIG. 3; and when the simultaneously received two diagonal spout-equipped bags 8 are tilted, they are tilted in the same direction; accordingly, as described in the above, the inclination of the left and right cam rails 59 are set so as to be mutually opposite.

In the system for manufacturing bags equipped with spouts and for packaging the diagonal spout-equipped bags described above, the bags 8 equipped with diagonal spouts manufactured by the rotary-type bag manufacturing device 1 are supplied continuously (immediately after the bags are completed) to the rotary-type bag packaging device 2 via the rotary-type bag transport device 3 without being stocked once as in the case in the past; accordingly, the operation of the rotary-type bag manufacturing device 1 for manufacturing bags equipped with spouts and the operation of the rotary-type bag packaging device 2 are linked, and thus the process flow of the bag manufacturing and bag packaging by such devices can be performed continuously; and as a result, it is possible to perform more efficient bag manufacturing and bag packaging, improving the productivity. In addition, the diagonal spout-equipped bags 8 manufactured by the rotary-type bag manufacturing device 1 for manufacturing bags with diagonal spouts are transported to the outside of the bag manufacturing device 1 in a constant orientation and direction, and such bags are not stocked once as was the case in the past; accordingly, it is possible to transport the bags to the rotary-type bag packing and packing device 2 with the orientation and direction of the bags kept consistently.

The bag transport and tilt-correction device 4 first eliminates the tilt that occurs in the diagonal spout-equipped bags 8 and then supplies the bags to the rotary-type bag packaging device 2; accordingly, it is possible to prevent inclined printing and bag-mouth sealing of the product bag 31. Also, because the tilt-correction for the bags is performed during the process of the transportation of the bags by the bag transport and tilt-correction device 4, the productivity of the overall system is not inhibited, and there is obviously no increase in complexity of the structure of the rotary-type bag packaging device 2 or decrease in its productivity.

Tilt in the bags can occur not only for a diagonal spout-equipped bag 8 which is laterally asymmetrical but also for a typical bag that is not equipped with a spout (including, among others, flat bags, self-standing bags and gusset bags), and it can also occur when bags that are stocked in a stacked manner together are supplied to a bag supply magazine or conveyor magazine-type bag supply device and then supplied to the bag packaging device via the bag receiving and transfer device (which can be the same type as that of the system bag receiving device 10 described above). In this case, with an installation of the bag transport and tilt-correction device 4 between the bag receiving and transfer device and the bag packaging device, it is possible to correct the tilt of the bag that occurred at the bag supply magazine or conveyor magazine-type bag supply device. Accordingly, though the bag transport and tilt-correction device 4 is described so as to be used in a specific system for manufacturing bags equipped with spouts and for packaging the bags in the structure shown in FIG. 1 through FIG. 6, the subject of application of the bag transport and tilt-correction device 4 is not limited to the above-described systems.

Also, though the above-described system (and the bag transport and tilt-correction device) is a so-called W-type system, the present invention is applicable to a system (and to a bag transport and tilt-correction device) of a type that performs processing of one bag at a time in sequence.

Figure 7:
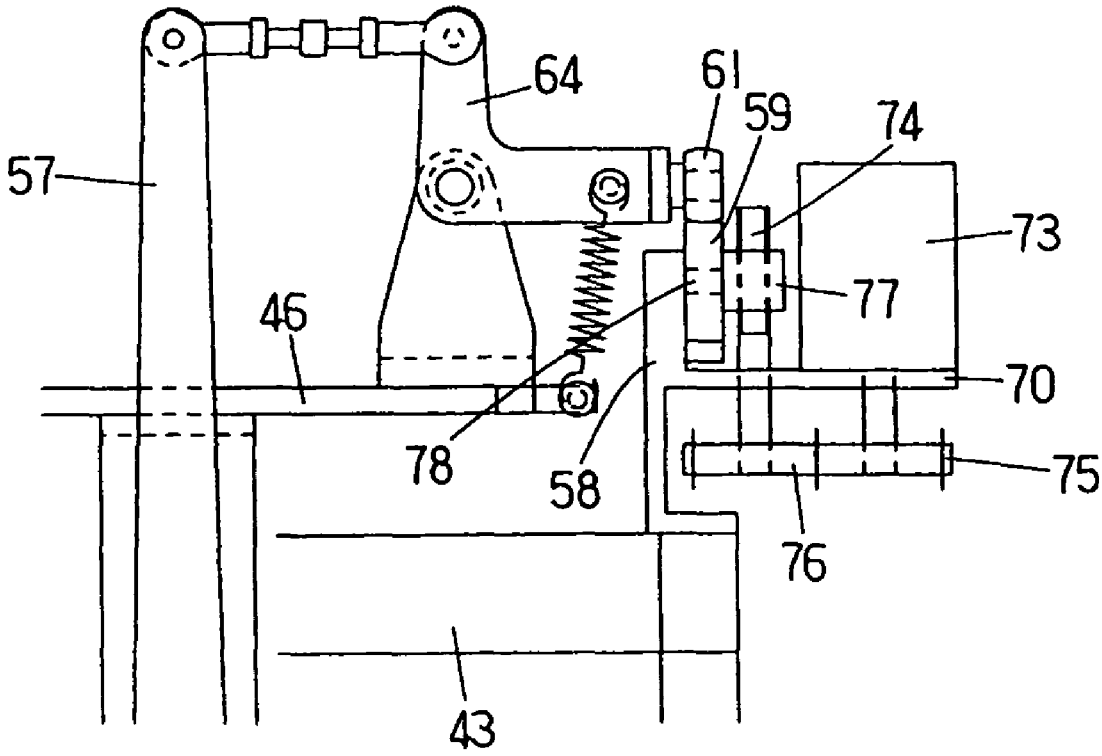
FIG. 7 is a front view near the cam rail of a bag transport and tilt-correction device according to another embodiment of the present invention.
Figure 8:
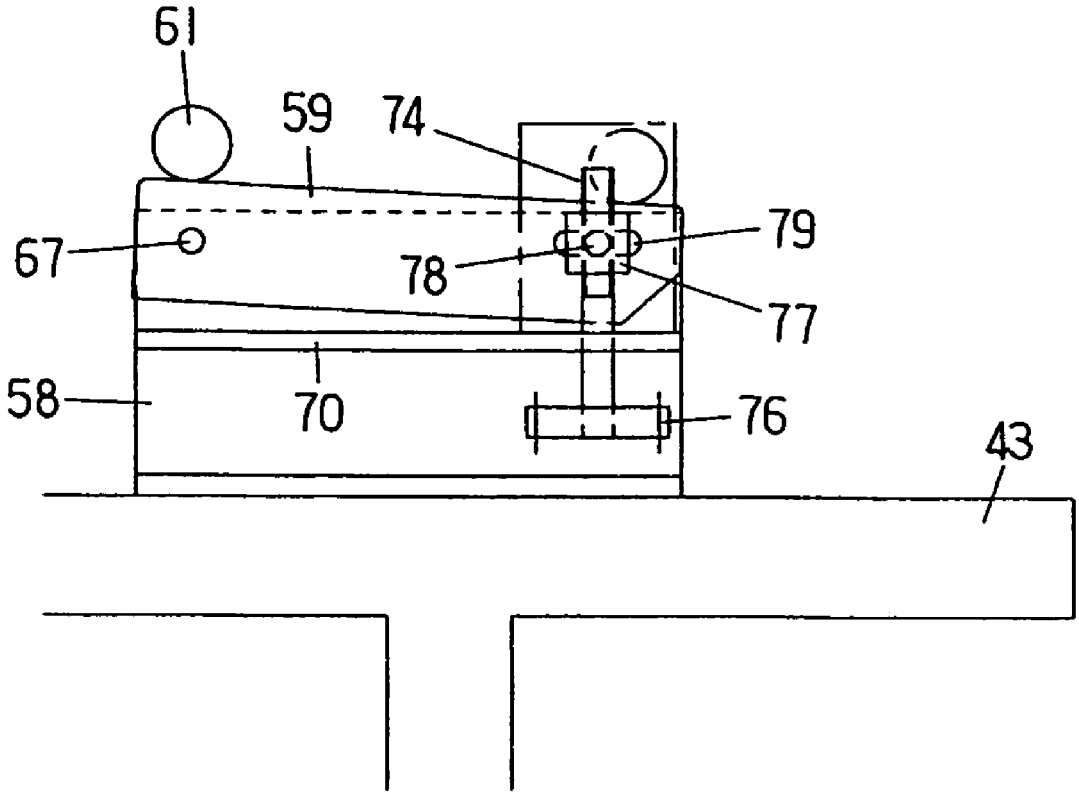
FIG. 8 is a right side view near the cam rail of the bag transport and tilt-correction device of FIG. 7.

FIGS. 7 and 8 shows a bag transport and tilt-correction device 4 of another type. The device shown in FIGS. 7 and 8 only differs from the device shown in FIGS. 2 through 6 in that the correction of the tilt of the diagonal spout-equipped bags 8 is performed automatically. In FIGS. 7 and 8, the same reference numbers are given to the elements that are substantially the same as those of the device of FIGS. 2 through 6.

In this bag transport and tilt-correction device 4 shown in FIGS. 7 and 8, the height (incline) along the length direction of the cam rail 59 is automatically changed. So as to accomplish this, a servo motor 73 is installed on the rib 70 of the attachment member 58, the adjustment shaft 74 is supported so as to be rotatable, and the output gear 75 of the servo motor 73 and the gear 76 fixed to the adjustment shaft 74 are meshed together; and in addition, the adjustment piece 77 is screwed to the adjustment shaft 74, and the shaft 78 fixed to the adjustment piece 77 is engaged in the slot 79 formed substantially horizontally in the cam rail 59. In addition, at the stop position II of the rotary-type bag transport device 3, a detection device (not illustrated) that detects the tilt of the diagonal spout-equipped bags 8 that are gripped by the gripping member of the rotary-type bag transport device 3 is installed so as to correspond to the diagonal spout-equipped bag 8.

In this bag transport and tilt-correction device 4, when the diagonal spout-equipped bags 8 gripped by the gripping members are stopped at the stop position II of the rotary-type bag transport device 3, the tilt of each one of the diagonal spout-equipped bags 8 is detected by the detection device, and the detection signal is sent to a control device (not illustrated); and then the control device operates the servo motor 73 according to the detected tilt (or the detection signal). The adjustment shaft 74 is thus rotated, the cam rail 59 is turned with the support pin 67 as the center of turning, and the height of the cam rail 59 along the length direction (tilt) is set to a specified (desired) height.

This setting of the height of the cam rail 59 can be performed each time the diagonal spout-equipped bags 8 gripped by the gripping members are stopped at the stop position II of the rotary-type bag transport device 3 (performed for each bag), for example; and it is also possible to perform this setting once at the first start of operation of the system, and as long as the manufacturing conditions (bag size, type, sealing conditions and the like) are not subsequently changed, the setting is kept unchanged.

As described above, tilt in the bags can occur not only for a diagonal spout-equipped bag 8 which is laterally asymmetrical, and it can also occur for a typical bag that is not equipped with a spout (including, among others, flat bags, self-standing bags and gusset bags); and further, it would occur when the bags that are stocked in a stacked manner together are supplied to a bag supply magazine or conveyor magazine-type bag supply device and supplied to the bag packaging device via the bag receiving and transfer device (which can be the same type as that of the system bag receiving device 10 described above). In this case, by installing the bag transport and tilt-correction device 4 shown in FIGS. 7 and 8 between the bag receiving and transfer device and the bag packaging device, it is possible to automatically correct the tilt of the bag that occurred at the bag supply magazine or conveyor magazine-type bag supply device. More specifically, for example, the tilt of the bag immediately before being supplied (which are the bag at the very top position within a bag supply magazine or the first bag within a conveyor magazine-type bag supply device) or the tilt of the bag during the transportation by the bag receiving and transfer device is detected, and then the servo motor 73 is operated based on that detection signal. As seen from the above, in the structure shown in FIGS. 7 and 8, the bag transport and tilt-correction device 4 is applied to a specific system for manufacturing bags equipped with spouts and for packaging the bags. However, the applicability of the bag transport and tilt-correction device 4 is not limited to the system described above.

The invention claimed is:

1. A bag transport and tilt-correction device comprising:

a gripping member which is openable and closable and, when closed, grips a top edge part of a bag supplied in a substantially vertical orientation and suspends the bag, an opening and closing means for opening and closing the gripping member, a reciprocal movement means for reciprocating the gripping member between a bag receiving position and a bag hand-over position, and a reciprocal swing means for swinging the gripping member within a vertical plane along a width direction of the gripped bag during the reciprocating motion of the gripping member;

wherein the gripping member is:

closed at the bag receiving position to grip the top edge part of the bag, swung within the vertical plane during the process of being moved to the bag hand-over position to correct tilt of the bag, and opened at the bag hand-over position to release the bag.

2. A bag transport and tilt-correction device comprising:

a gripping member which is openable and closable and, when closed, grips a top edge part of a bag supplied in a substantially vertical orientation and suspends the bag, an opening and closing means for opening and closing the gripping member, a reciprocal movement means for reciprocating the gripping member between a bag receiving position and a bag hand-over position, and a reciprocal swing means for swinging the gripping member within a vertical plane along a width direction of the gripped bag during the reciprocating motion of the gripping member;

wherein the gripping member is:

closed at the bag receiving position to grip the top edge part of the bag, swung within the vertical plane during the process of being moved to the bag hand-over position to correct tilt of the bag, and opened at the bag band-over position to release the bag; and wherein the reciprocal movement means is provided with a reciprocal moving body that reciprocates in a horizontal direction, and the gripping member is supported on the reciprocal moving body so as to swing within the vertical plane, the reciprocal swing means is comprised of a swing lever connected to a swing shaft of the gripping member, a cam rail installed along a direction of the movement of the reciprocal moving body on a fixed frame, a height of the cam rail being adjustable along the length direction of the cam rail, a driven body which is moved on the cam rail by the reciprocating motion of the reciprocal moving body, and a linking mechanism that links the swing lever and the driven body; and wherein during the reciprocating motion of the reciprocal moving body, the swing lever swings within the vertical plane via the driven body and the linking mechanism, and the gripping member swings within the vertical plane.

3. The bag transport and tilt-correction device according to claim 2, wherein the height of the cam rail is adjustable in a length-wise direction thereof by a servo motor, and a bag transport and tilt-correction device is further provided with a detection means for detecting tilt of the supplied bag and with a control means for controlling the servo motor based on a detection signal of the detection means.

* * * * *